US010216119B2

(12) United States Patent
Ishizumi et al.

(10) Patent No.: US 10,216,119 B2
(45) Date of Patent: Feb. 26, 2019

(54) IMAGE FORMING APPARATUS WITH ADJUSTMENT OF POTENTIAL FOR SECONDARY TRANSFER

(71) Applicant: CANON KABUSHIKI KAISHA, Tokyo (JP)

(72) Inventors: Keisuke Ishizumi, Hiratsuka (JP); Seiji Saito, Mishima (JP); Toshihiko Takayama, Kawasaki (JP); Masaru Ohno, Ebina (JP); Shingo Ito, Tokyo (JP); Shohei Ishio, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/664,239

(22) Filed: Jul. 31, 2017

(65) Prior Publication Data

US 2018/0039209 A1 Feb. 8, 2018

(30) Foreign Application Priority Data

Aug. 4, 2016 (JP) ..... 2016-153993

(51) Int. Cl.
*G03G 15/16* (2006.01)

(52) U.S. Cl.
CPC ..... *G03G 15/1605* (2013.01); *G03G 15/1675* (2013.01)

(58) Field of Classification Search
CPC ..... G03G 15/1605; G03G 15/1675; G03G 21/20; G03G 2215/0122; G03G 2215/1623

(Continued)

(56) References Cited

U.S. PATENT DOCUMENTS 8,909,111 B2 * 12/2014 Kawaguchi ..... G03G 15/162 399/302
9,002,227 B2 4/2015 Ohno et al.
(Continued)

FOREIGN PATENT DOCUMENTS

JP 2012-128364 A 7/2012
JP 2013025222 A * 2/2013
(Continued)

OTHER PUBLICATIONS

U.S. Appl. No. 15/662,832, Seiji Saito, Keisuke Ishizumi, Toshihiko Takayama, Masaru Ohno, Shingo Ito, Shohei Ishio, Keisuke Samejima, Keizo Kojima, Ryo Matsumura, filed Jul. 28, 2017.

*Primary Examiner* — Robert Beatty
(74) *Attorney, Agent, or Firm* — Venable LLP

(57) ABSTRACT

A voltage applying portion applies voltage to a current supply member, the current supply member being provided with primary transfer voltage to pass current through a contact portion contacting with a belt, thereby bringing the potential of the belt a primary transfer potential, and being provided with secondary transfer voltage so that a potential difference for secondary transfer is formed between the current supplying member and a support member while a recording material is nipped by the contact portion. The voltage applying portion changes the second transfer voltage so that the potential difference for the secondary transfer between the current supply member and the support member becomes smaller as a potential adjusting portion that maintains the potential of the support member at a prescribed sustaining potential in a variable manner in order to change a primary transfer potential reduces gradually the sustaining potential.

11 Claims, 12 Drawing Sheets

(58) Field of Classification Search
USPC ..... 399/44, 66, 302, 314
See application file for complete search history.

(56) References Cited

U.S. PATENT DOCUMENTS

| | | | | |
|---|---|---|---|---|
| 9,063,497 | B2 * | 6/2015 | Katagiri | G03G 15/5004 |
| 9,158,238 | B2 * | 10/2015 | Katagiri | G03G 15/1675 |
| 9,195,174 | B2 | 11/2015 | Kobayashi et al. | |
| 9,229,400 | B2 * | 1/2016 | Ito | G03G 15/1605 |
| 9,454,108 | B2 | 9/2016 | Katagiri et al. | |
| 2015/0093133 | A1 * | 4/2015 | Nakaegawa | G03G 15/0189 399/66 |
| 2015/0185666 | A1 * | 7/2015 | Nakaegawa | G03G 15/1665 399/66 |
| 2015/0212457 | A1 * | 7/2015 | Kanno | G03G 15/1605 399/66 |
| 2016/0223956 | A1 * | 8/2016 | Nakaegawa | G03G 15/1605 |

FOREIGN PATENT DOCUMENTS

| | | | | | |
|---|---|---|---|---|---|
| JP | 2013-213990 | A | | 10/2013 | |
| JP | 2013213995 | A | * | 10/2013 | |
| JP | 2013231958 | A | * | 11/2013 | G03G 15/0189 |
| JP | 2015011063 | A | * | 1/2015 | G03G 15/80 |

* cited by examiner

FIG.3
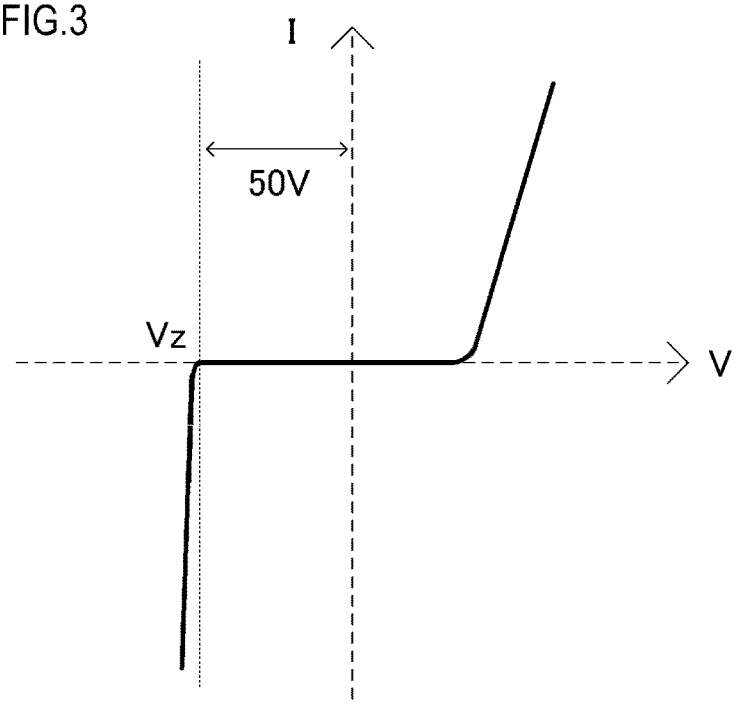
FIG.4
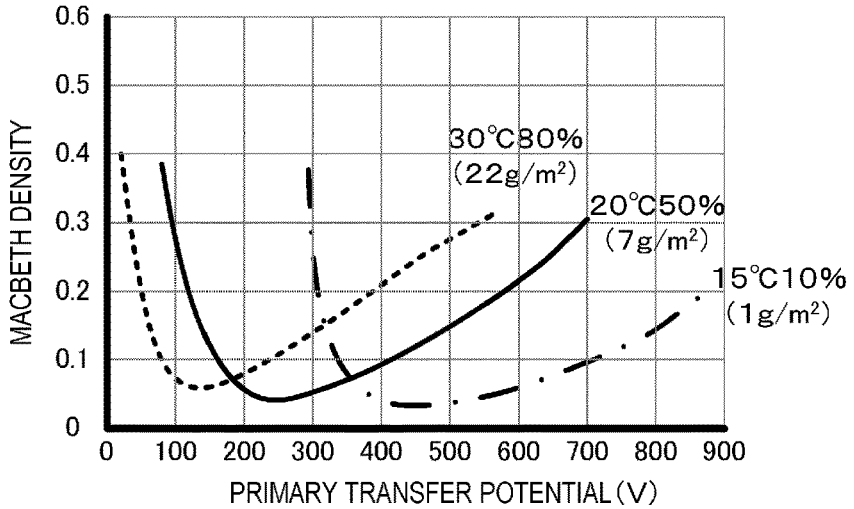
FIG.5
| ABSOLUTE WATER AMOUNT (g/m²) | 0～3.1 | 3.2～14.5 | 14.6～ |
|---|---|---|---|
| PRIMARY TRANSFER VOLTAGE (V) | 450V | 250V | 150V |
| ZENER DIODE CONNECTION | 15c | 15a | 15b |

| ABSOLUTE WATER AMOUNT (g/m$^2$) | 0～3.1 | 3.2～14.5 | 14.6～ |
|---|---|---|---|
| $\alpha$ | 1.8 | 1.6 | 1.4 |
| $\beta$ | 2100 | 1200 | 300 |

V0
SECONDARY TRANSFER ROLLER 20
V0'
SECONDARY TRANSFER ROLLER 20
V0'
V0'
Vd
SECONDARY TRANSFER COUNTER ROLLER 13
Vd
0
SECONDARY TRANSFER COUNTER ROLLER 13

FIG.10

| | No | ABSOLUTE WATER AMOUNT ($g/m^2$) | POTENTIAL OF SECONDARY TRANSFER COUNTER ROLLER 13 (V) | $\alpha$ | V0 | $\beta$ | Vt | POTENTIAL DIFFERENCE FROM SECONDARY TRANSFER COUNTER ROLLER 13 (V) | IMAGE FAILURES |
|---|---|---|---|---|---|---|---|---|---|
| COMPARATIVE EXAMPLES (Vt) | 1 | 0～3.1 | 450 | 1.8 | 950 | 2100 | 3810 | **3360** | BLANK BY EXCESSIVE CURRENT, DISCHARGE UNEVENNESS |
| | 2 | 3.2～14.5 | 250 | 1.6 | 750 | 1200 | 2400 | **2150** | BLANK BY EXCESSIVE CURRENT |
| | 3 | 14.6～ | 150 | 1.4 | 650 | 300 | 1210 | **1060** | BLANK BY EXCESSIVE CURRENT |
| EMBODIMENT (Vt´´) | 4 | 0～3.1 | 450 | 1.8 | 950 | 2100 | 3450 | **3000** | NO PROBLEMS |
| | 5 | 3.2～14.5 | 250 | 1.6 | 750 | 1200 | 2250 | **2000** | NO PROBLEMS |
| | 6 | 14.6～ | 150 | 1.4 | 650 | 300 | 1150 | **1000** | NO PROBLEMS |

| ABSOLUTE WATER AMOUNT (g/m$^2$) | 14.6～16.6 | 16.7～18.7 | 18.8～ |
|---|---|---|---|
| $\gamma$ | 150 | 100 | 50 |

FIG.14

| | No | ABSOLUTE WATER AMOUNT ($g/m^2$) | POTENTIAL OF SECONDARY TRANSFER COUNTER ROLLER 13 (V) | $\alpha$ | V0 | $\beta$ | $\gamma$ | Vt | POTENTIAL DIFFERENCE FROM SECONDARY TRANSFER COUNTER ROLLER 13 (V) | IMAGE FAILURES |
|---|---|---|---|---|---|---|---|---|---|---|
| COMPARATIVE EXAMPLES (Vt) | 1 | 14.6～16.6 | 150 | 1.4 | 650 | 300 | 150 | 1060 | 910 | BLANK BY EXCESSIVE CURRENT |
| | 2 | 16.7～18.7 | 150 | 1.4 | 650 | 300 | 100 | 1110 | 960 | BLANK BY EXCESSIVE CURRENT |
| | 3 | 18.8～ | 150 | 1.4 | 650 | 300 | 50 | 1160 | 1010 | BLANK BY EXCESSIVE CURRENT |
| EMBODIMENT (Vt´´) | 4 | 14.6～16.6 | 150 | 1.4 | 650 | 300 | 150 | 1000 | 850 | NO PROBLEMS |
| | 5 | 16.7～18.7 | 150 | 1.4 | 650 | 300 | 100 | 1050 | 900 | NO PROBLEMS |
| | 6 | 18.8～ | 150 | 1.4 | 650 | 300 | 50 | 1100 | 950 | NO PROBLEMS |

IMAGE FORMING APPARATUS WITH ADJUSTMENT OF POTENTIAL FOR SECONDARY TRANSFER

BACKGROUND OF THE INVENTION

Field of the Invention

The present invention relates to an image forming apparatus using an electrophotographic system.

Description of the Related Art

There have been known image forming apparatuses such as a copier and a laser beam printer provided with an endless belt as an intermediate transfer member. Such an image forming apparatus transfers, in a primary transfer step, a toner image formed on a surface of a photosensitive drum as an image bearing member onto a belt by applying voltage from a voltage source to a primary transfer member provided at a part opposed to the photosensitive drum. Thereafter, the primary transfer step is repeated for toner images in multiple colors, so that the toner images in the multiple colors are formed on the belt surface. Subsequently, in a secondary transfer step, the toner images in the multiple colors formed on the belt surface are transferred together onto a surface of a recording material such as a paper sheet by applying voltage to a secondary transfer member. The toner images transferred together are then permanently fixed on the recording material by fixation means, so that a resultant color image is formed.

Japanese Patent Application Publication No. 2013-213990 discloses an image forming apparatus configured to have a changeable potential on the belt surface, which allows the device size to be reduced and the cost to be lowered. The image forming apparatus disclosed in that document includes a circuit that has a plurality of Zener diodes set in different voltage levels between the belt and ground. In the configuration, a current supply member such as a secondary transfer roller in contact with the belt outer surface supplies current to a stretching roller as a support member for the belt, so that the belt surface has a potential and the primary transfer is carried out. The potential at the belt surface is changed by switching the connection with the plurality of Zener diodes depending on the use environment and durability, so that the primary transfer efficiency is stabilized.

SUMMARY OF THE INVENTION

In a general primary transfer portion configuration, while a plurality of members including a photosensitive drum, an intermediate transfer member, and a primary transfer member are present, the surrounding environment and the situation of how the main body of the image forming apparatus is used may change the resistance of the primary transfer portion or the optimum primary transfer current may change. In the configuration disclosed in Japanese Patent Application Publication No. 2013-213990, the surrounding environment is detected and voltage maintaining means is switched accordingly, while the surface potential of the photosensitive drum is adjusted, so that optimum transferability may be secured. However, the potential of the stretching roller changes when the voltage maintaining means is switched, and therefore the potential difference between the current supply member such as the secondary transfer roller provided opposed to the stretching roller and the tension roller as the support member for the belt changes. For example, during secondary transfer, the potential difference between the secondary transfer roller and the belt surface fluctuates as the setting for sustaining voltage is changed and may deviate from the optimum potential difference for the secondary transfer, which could give rise to deterioration in the secondary transferability.

An object of the present invention is to provide an image forming apparatus capable of preventing image failures that could be caused by potential difference fluctuations between the current supply member and the belt support member in the secondary transfer.

In order to achieve the object, an image forming apparatus according to the present invention comprises:

an image bearing member that bears a toner image;

an endless belt that rotates while being in contact with the image bearing member, the toner image borne by the image bearing member being subjected to primary transfer, the belt subjecting the primary-transferred toner image to secondary transfer onto a recording material;

a support member that supports an inner peripheral surface of the belt;

a current supply member that is in contact with the belt in a position opposed to the support member through the belt and that is provided with voltage to pass current through a contact portion contacting with the belt, the current supply member being provided with primary transfer voltage, so that current is passed through the contact portion in order to bring a potential of the belt to a primary transfer potential for the primary transfer, and with secondary transfer voltage, so that a potential difference for the secondary transfer is formed between the support member and the current supply member while the recording material is nipped by the contact portion;

a voltage applying portion that applies voltage to the current supplying member; and a potential adjusting portion that is capable of variably maintaining a potential of the support member at a prescribed sustaining potential and capable of changing the sustaining potential to change the primary transfer potential, the voltage applying portion changing a level of the secondary transfer voltage so that the potential difference between the current supplying member and the support member for the secondary transfer becomes smaller as the potential adjusting portion reduces gradually the sustaining potential.

According to the present invention, image failures that could be generated by potential difference fluctuations between the current supply member and the belt support member in the secondary transfer can be prevented.

Further features of the present invention will become apparent from the following description of exemplary embodiments with reference to the attached drawings.

BRIEF DESCRIPTION OF THE DRAWINGS

FIG. 3 is a graph showing a voltage-current characteristic of a Zener diode;

FIG. 4 is a graph for illustrating primary transfer characteristic;

FIG. 5 is a table showing setting of primary transfer voltage corresponding to an absolute water amount;

FIG. 10 is a table showing values for tip end voltage according to the first embodiment and comparative examples of tip end voltage;

FIG. 14 is a table showing values for minimum voltage according to the second embodiment and comparative examples of minimum voltage;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

General Description of Image Forming Apparatus

Figure 1:
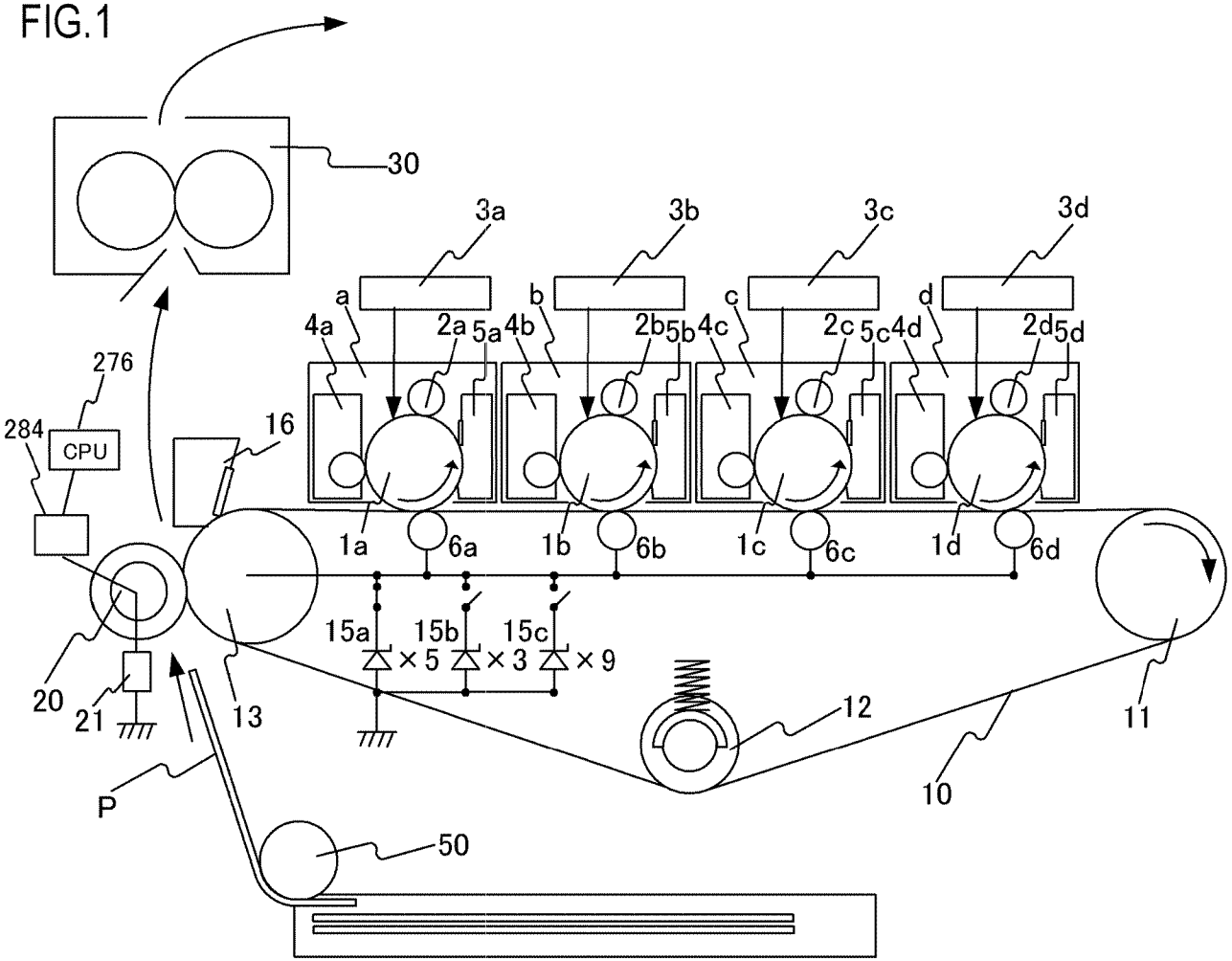
FIG. 1 is a view for illustrating an image forming apparatus according to a first embodiment of the invention.

FIG. 1 is a schematic view of an image forming apparatus according to a first embodiment of the present invention, and a configuration and operation of the image forming apparatus according to the embodiment will be described with reference to FIG. 1. Examples of the image forming apparatus to which the present invention is applicable include a copier and a printer using an electrophotograpic system, and a color laser printer will be described as an application example herein. Now, the image forming apparatus according to the embodiment is a so-called tandem type printer having a plurality of image forming stations a to d. The first image forming station a forms a yellow (Y) image, the second image forming station b forms a magenta (M) image, the third image forming station c forms a cyan (C) image, and the fourth image forming station d forms a black (Bk) image. The image forming stations have the same configuration other than the colors of toners stored by the stations, and therefore the first forming station a will be described.

The first image forming station a includes an electrophotographic photosensitive member (hereinafter referred to as the "photosensitive drum") 1*a*, a charging roller 2*a* as a charging member, a developing device 4*a*, and a cleaning device 5*a*. The photosensitive drum 1*a* is an image bearing member that is driven to rotate at a prescribed circumferential speed (process speed) in the direction of the arrow and bears a toner image (developer image). The developing device 4*a* is a device adapted to store a yellow toner as a developer and develop an electrostatic latent image formed on the photosensitive drum 1*a* using the yellow toner. The cleaning device 5*a* is a member adapted to recover the toner sticking to the photosensitive drum 1*a*. According to the embodiment, the cleaning device 5*a* includes a cleaning blade as a cleaning member in abutment against the photosensitive drum 1*a* and a waste toner box that stores the toner recovered by the cleaning blade.

When image forming operation starts in response to an image signal, the photosensitive drum 1*a* is driven to rotate. During the rotation, the photosensitive drum 1*a* is uniformly charged by the charging roller 2*a* to a prescribed potential with a prescribed polarity (the negative polarity according to the embodiment) and exposed to light according to the image signal by the exposure means 3*a*. In this way, an electrostatic latent image corresponding to the yellow color component image of a target color image is formed. Then, the electrostatic latent image is developed by the developing device (yellow developing device) 4*a* in a developing position and made visible as a yellow toner image. Here, the normal charging polarity of the toner stored in the developing device is negative.

An intermediate transfer belt 10 is an endless belt member. The intermediate transfer belt 10 is stretched on a driving roller 11, a tension roller 12, and a secondary transfer counter roller and driven to rotate while being in contact with the photosensitive drum 1*a* at substantially an equal circumferential speed in the same direction in which the photosensitive drum 1*a* moves at the opposed position in abutment against the photosensitive drum 1*a*. The primary transfer roller 6*a* is provided opposed to the photosensitive drum 1*a* with the intermediate transfer belt 10 therebetween. The yellow toner image formed on the photosensitive drum 1*a* is transferred onto the intermediate transfer belt 10 in the process of passing the abutment part (hereinafter referred to as the "primary transfer nip") between the photosensitive drum 1*a* and the intermediate transfer belt 10 as the primary transfer roller 6*a* is provided with voltage of the positive polarity (primary transfer). The method for the primary transfer will be described later. The primary transfer residual toner remaining on the surface of the photosensitive drum 1*a* is cleaned and removed by the cleaning device 5*a* and then subjected to the image forming process including charging and other steps. Then, similarly to the above, the second color magenta toner image, the third color cyan toner image, and the fourth color black toner image are formed by the second, third, and fourth image forming stations b, c, and d, respectively and sequentially transferred one upon another onto the intermediate transfer belt 10. In this way, a composite color image corresponding to the target color image is obtained.

The toner images in the four colors on the intermediate transfer belt 10 are supplied with a paper sheet by paper supply means 50 in the process of passing the secondary transfer nip formed by the intermediate transfer belt 10 and a secondary transfer roller 20 and transferred together onto the surface of the recording material P held by the secondary transfer nip (secondary transfer). The secondary transfer will be described later in detail. Then, the recording material P bearing the four color toner image is introduced into a fixing portion 30 and heated and pressurized therein, so that the toners in the four colors are melted and mixed to be fixed on the recording material P. The toner remaining on the intermediate transfer belt 10 after the secondary transfer is cleaned and removed by a cleaning device 16. The full-color printed image is formed by the above-described operation.

Description of Control Block Diagram

Figure 2:
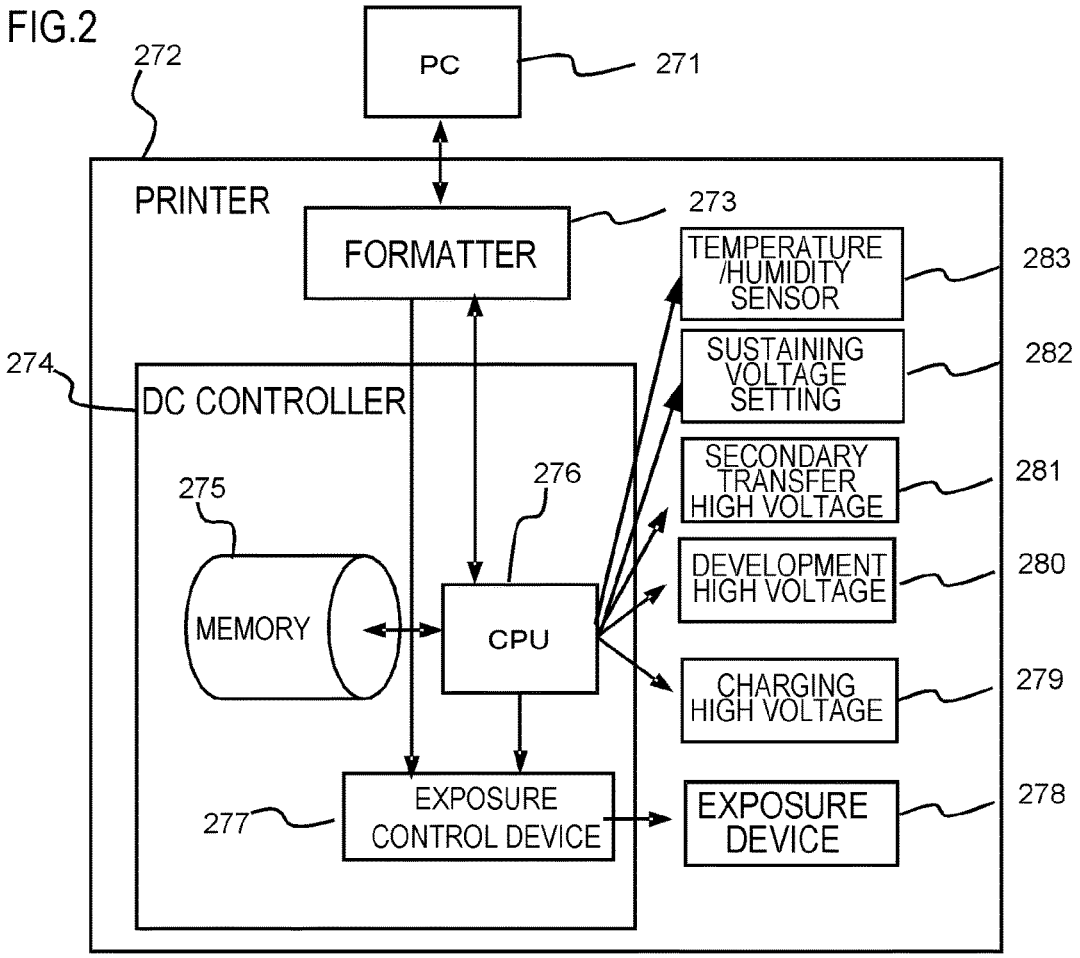
FIG. 2 is a control block diagram for showing control of the operation of the image forming apparatus.

FIG. 2 is a control block diagram showing control of the operation of an image forming apparatus according to the embodiment. A PC 271 as a host computer issues a printing instruction to a formatter 273 in the image forming apparatus 272 and transmits image data for an image to be printed to the formatter 273. The formatter 273 converts the image data from the PC 271 into exposure data and transfers the data to an exposure control portion 277 in a DC controller 274. The exposure control portion 277 controls an exposure device 278 by controlling the on/off of the exposure data in response to an instruction from a CPU 276 as a control portion. The CPU 276 starts an image forming sequence upon receiving a printing instruction from the formatter 273. The DC controller 274 includes the CPU 276, a memory 275, etc. and carries out preprogrammed operation. The CPU 276 forms an electrostatic latent image by controlling power supplies, i.e., charging high voltage 279, developing high voltage 280, and secondary transfer high voltage 281 and forms an image by controlling transfer, etc. of a developed toner image. As will be described, current supplied by the secondary transfer member also determines sustaining voltage that determines the potentials of a stretching roller 13 and the intermediate transfer belt 10 (sustaining voltage setting 282).

The CPU 276 carries out processing related to secondary transfer control. The CPU 276 includes a current detecting portion 284 (FIG. 1) that detects current passed through a secondary transfer member 20 and detects a current value for voltage to be applied to the secondary transfer member 20 in the secondary transfer control, so that the current values for the respective kinds of voltage are stored in the memory 275. After the end of the secondary transfer control, operation through the CPU 276 is carried out. The operation result is used for constant current control for keeping the current passed through the secondary transfer member 20 at a prescribed current level or for determining fixed voltage to be applied to the secondary transfer member when the recording material P reaches the secondary transfer member 20. The CPU 276 also controls a temperature/humidity sensor 283 as detection means, and an absolute water amount is calculated (obtained) from a temperature and a humidity in an atmosphere detected by the temperature/humidity sensor 283 and stored in the memory 275.

Description of Intermediate Transfer Belt

The intermediate transfer belt 10 has a thickness of 70 μm and a width of 250 mm and includes polyimide resin in an endless shape mixed with an ionic conductive agent as a conductive agent. While the ionic conductive agent has such a conductive characteristic that the resistance value fluctuates with respect to the temperature and the humidity in the atmosphere, the polyimide resin has its volume resistivity adjusted to $10^8$ Ω·cm in an environment at a temperature of 23° C. with a room humidity of 50%. The volume resistivity was measured using Hiresta-UP (MCP-HT450) and a ring probe UR (model: MCP-HTP12) manufactured by Mitsubishi Chemical Corporation. The intermediate transfer belt 10 having a peripheral length of 650 mm as a center value is stretched on the three shafts of the driving roller 11, the tension roller 12, and the secondary transfer counter roller 13 and driven to rotate by rotating the driving roller 11 by the same motor that drives the photosensitive drum 1 to rotate. The surface speed is set to 100 mm/sec for a center value of the diameter of the driving roller 11. Note that the ionic conductive agent is mixed as a conductive agent in the intermediate transfer belt according to the embodiment, while any other configuration may bring about the same effects as the embodiment. For example, an electronic-conductive intermediate transfer belt that provides conductivity by carbon dispersion may be used.

Description of Primary Transfer

The image forming apparatus in FIG. 1 does not include a power supply dedicated to primary transfer for the purpose of reducing the size of the apparatus or lowering the cost. More specifically, voltage is applied to the secondary transfer member 20 as the current supply member to pass current through the contact portion between the secondary transfer member 20 and the intermediate transfer belt 10, so that the surface potential of the intermediate transfer belt 10 is used as a prescribed primary transfer potential. In this configuration, the surface potential of the intermediate transfer belt 10 may be considered substantially equal to the potentials of the stretching roller 13 and the primary transfer rollers 6*a* to 6*d* as the potential maintaining members that support the intermediate transfer belt 10. Therefore, in order to carry out primary transfer of toner images from the photosensitive drum 1 onto the intermediate transfer belt 10, the primary transfer rollers 6*a* to 6*d* and the stretching roller 13 are connected to have an electrically equal potential, and the stretching roller 13 is provided with the potential to supply the primary transfer rollers 6*a* to 6*d* with voltage. In order to provide the stretching roller 13 with a potential as a prescribed sustaining potential, a Zener diode 15 as a voltage maintaining element configured to serve as a potential adjusting part between the stretching roller 13 and ground is provided, so that voltage drop between the intermediate transfer belt 10 and ground is maintained at a set voltage level. Current is supplied to the Zener diode 15 by a secondary transfer power supply 21 as a voltage application part that applies voltage to the secondary transfer member 20. The secondary transfer power supply 21 applies voltage to the secondary transfer member 20, and current is supplied to the Zener diode 15 through the stretching roller 13 from the secondary transfer member 20, so that the stretching roller 13 is provided with the potential.

Referring to FIG. 3, the characteristic of the Zener diode will be described. FIG. 3 shows the current-voltage characteristic of the Zener diode. The Zener diode has almost no current passed therethrough for a voltage level less than Zener diode yield voltage Vz and current suddenly passed therethrough for a voltage level equal to or higher than Vz, and current is passed therethrough so that the voltage drop is maintained at Vz in the range equal to or higher than the yield voltage Vz.

As shown in FIG. 1, 15*a* includes a series-connection of five Zener diodes with a yield voltage Vz of 50 V. Meanwhile, 15*b* includes a series-connection of three Zener diodes with 50 V, and 15*c* includes a series-connection of nine Zener diodes with 50 V. Then, 15*a*, 15*b*, and 15*c* are connected in parallel, and the secondary transfer counter roller 13 may be switchably connected to any one of 15*a*, 15*b*, and 15*c* depending on the situation. The yield voltage is 250 V (50 V×5), 150 V (50 V×3) and 450 V (50 V×9) when the roller is connected to 15*a*, 15*b* and 15*c*, respectively. The connection is switched among 15*a*, 15*b*, and 15*c* so that the intermediate transfer belt 10 can be maintained at an optimum potential for the primary transfer depending on the situation.

A value set for the primary transfer voltage will be described. Since the primary transfer rollers 6*a* to 6*d* and the secondary transfer counter roller 13 are connected to the same potential, the potential of the secondary transfer counter roller 13 is equal to the primary transfer voltage.

FIG. 4 is a graph showing primary transfer performance for the temperature and the humidity in the atmosphere, and the abscissa represents the primary transfer voltage. The ordinate in FIG. 4 represents the toner density on the photosensitive drum 1 after the primary transfer and corresponds to the amount of toner untransferred onto the intermediate transfer belt 10. The toner density on the ordinate shows a measurement result using an optical densitometer, X-rite504A (manufactured by X-Rite Inc.), and the lower values indicate better primary transfer performance. The curves in the graph in FIG. 4 represent densities at 30° C. with a humidity of 80% (a high temperature and high humidity environment), at 20° C. with a humidity of 50% (a room temperature and normal humidity environment), and at 15° C. with a humidity of 10% (a low temperature and low humidity environment), and numbers in the parentheses are absolute water amounts for the respective temperature and humidity values.

When the primary transfer voltage is too low, a current shortage prevents a toner image on the photosensitive drum 1 from being transferred onto the intermediate transfer belt 10 or a blank by weak current is generated, and therefore more toner remains on the photosensitive drum 1 after the primary transfer as the potential is lower. Meanwhile, when the primary transfer voltage is too high, discharge current generated between the photosensitive drum 1 and the intermediate transfer belt 10 inverts the polarity of the toner on the photosensitive drum 1 from the negative polarity to the positive polarity before the primary transfer, so that the toner image is not transferred onto the intermediate transfer belt 10 or a blank by excessive current is generated. Therefore, the toner amount remaining on the photosensitive drum 1 after the primary transfer increases when the primary transfer voltage is too high.

As described, in order to obtain good primary transfer performance, an optimum value must be set for the primary transfer voltage depending on the temperature and the humidity in the atmosphere. The primary transfer performance fluctuates depending on the temperature and the humidity because the electric charge of the toner changes or the resistance value of the intermediate transfer belt 10 changes. According to the embodiment, optimum primary transfer voltage is set depending on the temperature and the humidity in the atmosphere.

Description of Set Value for Primary Transfer Voltage

Referring to FIG. 5, a method for setting the primary transfer voltage will be described. According to the embodiment, a set value for the primary transfer voltage is determined on the basis of an absolute water amount determined on the basis of a temperature and a humidity detected by an environment sensor 283. FIG. 5 is a table showing set values for the primary transfer voltage for absolute water amounts. As shown in FIG. 5, an optimum value for the primary transfer voltage is set by switching the connection of the Zener diode among 15*a* to 15*c* depending on the value of the absolute water amount. The switching allows the image forming apparatus according to the embodiment to achieve primary transfer performance in a practically acceptable level in any of the environments.

Description of Secondary Transfer Member

The secondary transfer roller 20 as the secondary transfer member having an outer diameter of 18 mm is obtained by covering a nickel-plated steel rod having an outer diameter of 8 mm with a foamed sponge body including NBR and epichlorohydrin rubber as main constituents and having an adjusted volume resistivity of $10^8$ Ω·cm and an adjusted thickness of 5 mm. The secondary transfer roller 20 abuts against the intermediate transfer belt 10 with a pressurizing force of 50 N to form a secondary transfer part (hereinafter referred to as the "secondary transfer nip"). The secondary transfer roller 20 rotates by following the intermediate transfer belt 10 and is provided with voltage of the positive polarity in order to carry out secondary transfer of the toner on the intermediate transfer belt 10 onto the recording material P such as a paper sheet.

Description of Secondary Transfer Control

In the secondary transfer, toner images in a plurality of colors borne on the intermediate transfer belt 10 are transferred together onto the recording material P. In order to transfer the toner images on the intermediate transfer belt 10 onto the recording material, there must be a prescribed potential difference between the secondary transfer roller 20 and the secondary transfer counter roller 13. The potential difference between the secondary transfer roller 20 and the secondary transfer counter roller 13 is determined on the basis of voltage to be applied to the secondary transfer roller 20 by the secondary transfer power supply 21 and the potential of the secondary transfer counter roller 13 determined by the Zener diode 15.

In the secondary transfer, in order to transfer the toner images on the intermediate transfer belt 10 onto the recording material, current in a desired level must be passed from the secondary transfer roller 20 and the secondary transfer counter roller 13. Therefore, constant current control is normally carried out for providing a prescribed level of current. However, the constant current control takes time for the control until the prescribed current level is attained, and the desired current level is not yet reached when the tip ends of the toner images on the intermediate transfer belt 10 reach the secondary transfer member 20. As a result, a current shortage may cause a transfer failure or excessive current may invert the polarity of the toner images into the positive polarity, which causes an image failure such as an inversion blank in the timing in which the tip ends of the toner images on the recording material reach the secondary transfer roller 20.

Therefore, in order to prevent the secondary transfer failures at the tip ends of the toner images on the recording material, fixed voltage is applied to the secondary transfer roller 20 before the arrival of the recording material (immediately before the start of the constant current control). The fixed voltage to be applied before the arrival of the recording material will be hereinafter referred to as the "tip end voltage." The voltage-current characteristic of the secondary transfer roller 20 is previously detected, and the tip end voltage is estimated and applied as voltage close to voltage applied to the secondary transfer roller 20 under the constant current control.

Detection of Voltage-Current Characteristic of Secondary Transfer Roller

The voltage-current characteristic of the secondary transfer roller 20 will be described. The voltage-current characteristic is detected for the purpose of determining the average of voltage across the secondary transfer roller 20 necessary for prescribed current. In the following description of the embodiment, the average voltage for a current of 15 μA passed through the secondary transfer roller 20 is determined by way of illustration. When for example a temperature and a humidity detected by a temperature/ humidity sensor are in the range of the room temperature and normal humidity environment, the voltage-current characteristic detection is carried out while the Zener diode 15*b* is in a conduction state and the intermediate transfer belt 10 is rotated to have the secondary transfer roller 20 follow to rotate.

Figures 6, 7:
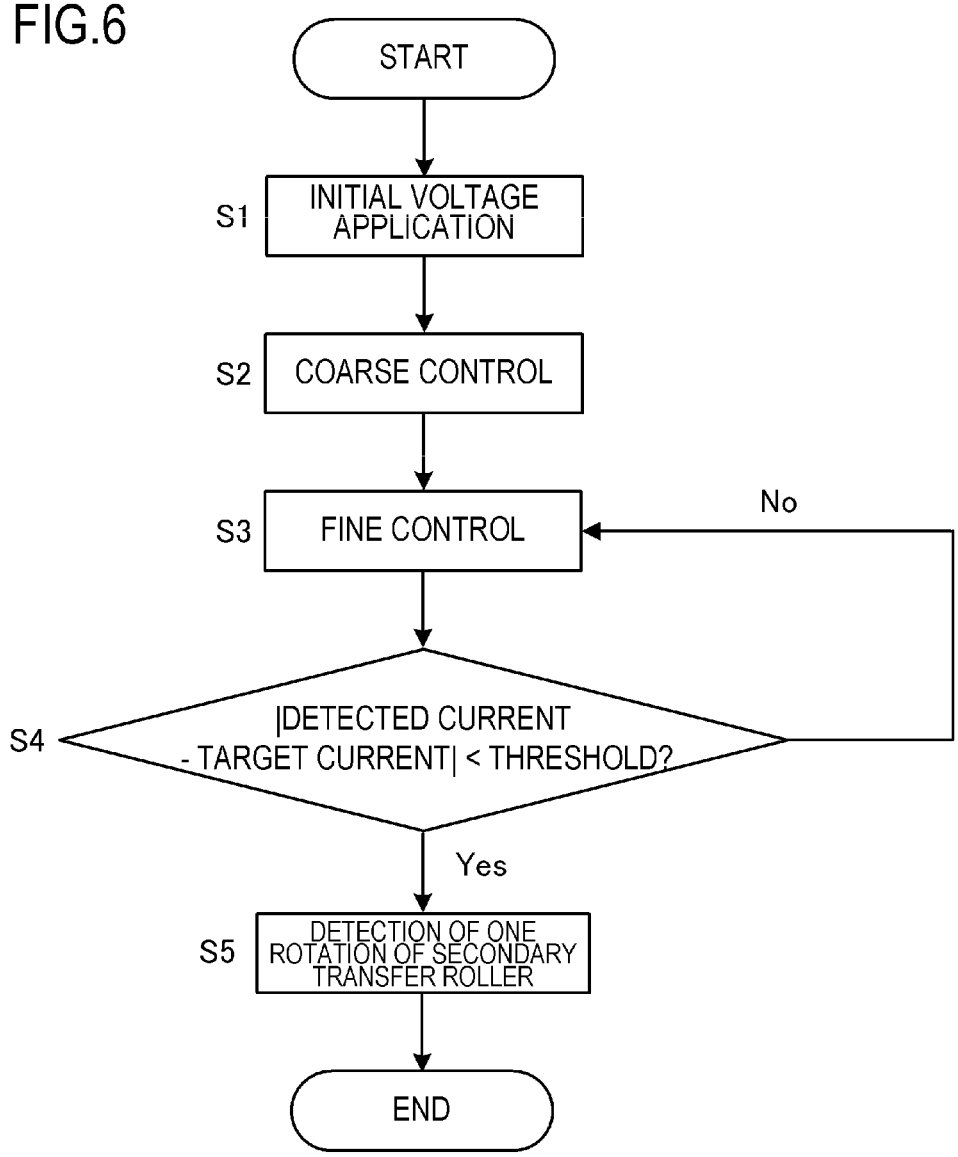
FIG. 6 is a flowchart for illustrating detection of a voltage-current characteristic of a secondary transfer roller.
FIG. 7 is a table showing setting of α and β corresponding to an absolute water amount.

FIG. 6 is a flowchart for illustrating detection of the voltage-current characteristic of the secondary transfer roller. After the detection starts, initial voltage is applied to the secondary transfer roller 20 in S1 in FIG. 6. According to the embodiment, the initial application voltage is 500 V. Then, coarse control and fine control are carried out. After the application voltage to the secondary transfer roller 20 is raised to the initial voltage, the coarse control is carried out in S2. In the coarse control, the application voltage to the secondary transfer roller 20 is changed from the initial voltage so that the current is within the range of 15 μA±2 μA. The voltage change amount at the time is about 50 V at intervals of 20 msec. Subsequently to the coarse control, the fine control in S3 is carried out. In the fine control, the application voltage to the secondary transfer roller 20 is changed from the initial voltage so that the current is within the range of 15 μA±0.8 μA. The voltage change amount at the time is about 15 V at intervals of 20 msec. After the current converges within the range of 15 μA±0.8 μA (YES in S4), the constant current control is carried out so that the current value is within 15 μA±0.8 μA, and sampling is carried out 30 times at intervals of 20 msec (S5). The average voltage at the time is V0. The voltage change amount for each of the 30 sampling occasions is about 15 V.

The number of sampling occasions is 30 because the sampling is carried out for a distance equal to or more than the circumference of the secondary transfer roller 20. Hereinafter, the voltage obtained by the voltage-current characteristic detection will be designated by V0. According to the embodiment, since the secondary transfer counter roller 13 has a potential Vd by the presence of the Zener diode 15, V0 is voltage raised by Vd. Note that the initial voltage may be a fixed value or may be determined on the basis of the detection result from the previous printing occasion in order to cause the convergence of the control to be faster.

The tip end voltage Vt is determined from the following Expression 1 on the basis of V0 obtained by the above detection.

$$Vt=\alpha V0+\beta \tag{1}$$

In Expression 1, α and β are fixed values predetermined by experiments and vary depending on the absolute water amount.

FIG. 7 is a table showing α and β for the absolute water amount. As shown in FIG. 7, α and β are set according to the value of the absolute water amount. An optimum value for the voltage Vt can be determined by setting values for α and β for each of the absolute water amounts.

Figure 8A:
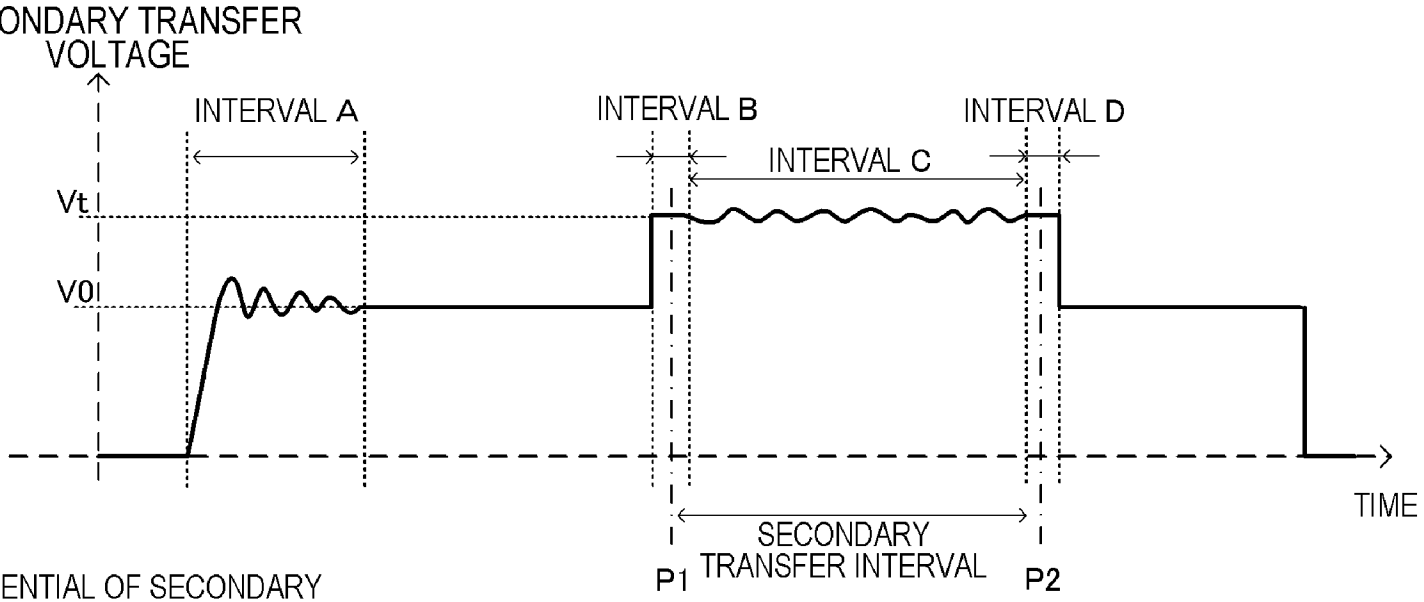
FIGS. 8A and 8B are timing charts for secondary transfer voltage according to the first embodiment.

Using the timing chart shown in FIGS. 8A and 8B, the timing for applying the voltage Vt will be described. FIG. 8A is a timing chart for the secondary transfer voltage and the potential of the secondary transfer counter roller 13.

In the interval A, the voltage-current characteristic of the secondary transfer member is detected, and V0 determined in the interval A continues to be applied until the tip end voltage Vt is applied.

The interval B is an interval for applying the tip end voltage Vt. In the timing P1 in the interval B, the tip end of the recording material P reaches the secondary transfer roller 20, and the tip end voltage Vt is applied before the reaching timing. It is to ensure that Vt is applied at the tip ends of the toner images even when the transport of the recording material P is delayed, and no image failure is generated at the tip ends of the toner images. According to the embodiment, the tip end voltage Vt starts to be applied when the tip end of the recording material P is positioned 2 mm before P1 in the design center and is applied for 7 mm.

The interval C is under the constant current control, and the toner images are subjected to secondary transfer. According to the embodiment, the constant current control at 15 μA is carried out.

In the interval D, voltage is applied in the vicinity of the rear end of the recording material P, and Vt is applied as rear end voltage immediately after the end of the constant current control in order to stabilize the transferability for the toner images in the vicinity of the rear end. The rear end of the recording material P passes the secondary transfer roller 20 in P2 in the interval D. The tip end voltage Vt starts to be applied in timing 7 mm before P2 and the application ends after the rear end of the recording material P passes ahead of the secondary transfer roller 20 and reaches a position 2 mm ahead. After the interval D, V0 continues to be applied until the end of the operation.

Figure 8B:
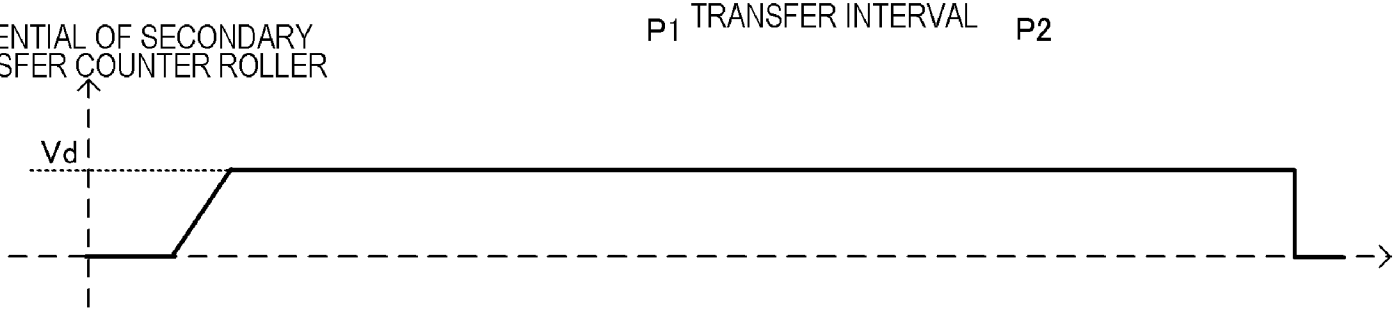

Note that as shown in FIG. 8B, the potential of the secondary transfer counter roller 13 is at Vd by current supplied from the secondary transfer roller 20 while voltage is applied to the secondary transfer roller 20.

Influence of Fluctuations of Potential of Secondary Transfer Counter Roller 13

Figures 9A, 9B:
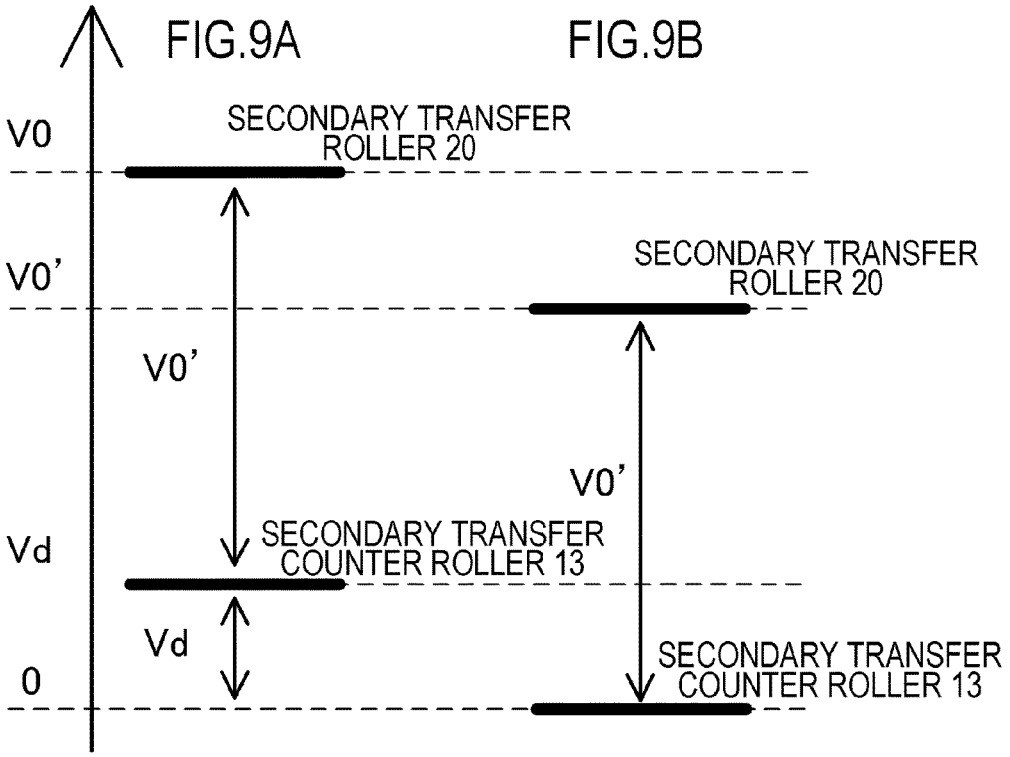
FIGS. 9A and 9B show a relation in potential between a secondary transfer roller 20 and a secondary transfer counter roller 13.

Referring to FIG. 9A and FIG. 9B, the influence of fluctuations of the potential of the secondary transfer counter roller 13 will be described. FIG. 9A and FIG. 9B show the relation in potential between the secondary transfer roller 20 and the secondary transfer counter roller 13.

FIG. 9A shows the relation in potential according to the embodiment. The voltage applied to the secondary transfer roller for the target current I0 based on the voltage-current characteristic detection is V0. Meanwhile, the potential of the secondary transfer counter roller 13 is Vd, and therefore a potential difference V0' necessary for passing I0 can be represented by the following Expressions.

$$V0'=V0-Vd \tag{2}$$

Then, the following expression holds.

$$V0=V0'+Vd \tag{3}$$

The tip end voltage Vt for V0 can be calculated from Expression 1 and can therefore be represented by the following expression. From Expression 3, $$\begin{aligned} Vt &= \alpha V0+\beta \\ &= \alpha(V0'+Vd)+\beta. \end{aligned} \tag{4}$$

When the tip end voltage Vt is applied, the following Expression 5 is established, where the current passed through the secondary transfer roller 20 is It and the composite resistance of the secondary transfer roller 20, and the recording material P, and the intermediate transfer belt 10 is R.

$$\begin{aligned} It &= (Vt-Vd)/R \\ &= (\alpha V0'+\beta)/R+\{(\alpha-1)Vd\}/R \end{aligned} \tag{5}$$

Expression 5 indicates that the value for It changes depending on Vd or on the potential of the secondary transfer counter roller 13.

FIG. 9B shows the relation in potential when the potential of the secondary transfer counter roller 13 is zero. The potential difference necessary for passing target current I0 on the basis of the voltage-current characteristic detection is V0' similarly to FIG. 9A, and therefore the application voltage to the secondary transfer roller 20 is also V0' at the time.

Tip end voltage Vt' when Expression 1 is adapted to FIG. 9B can be represented by the following Expression 6.

$$Vt'=\alpha V0'+\beta \tag{6}$$

Current It' passed through the secondary transfer roller 20 for the applied tip end voltage Vt' can be represented by the following Expression 7.

$$It'=(\alpha V0'+\beta)/R \tag{7}$$

As can be understood from Expression 7, It' is uniquely determined by V0'.

Here, the difference ΔIt between It' and It is obtained from the following Expression 8.

$$\begin{aligned}\Delta It &= It' - It \\ &= \{(\alpha-1)Vd\}/R\end{aligned} \tag{8}$$

Expression 8 indicates that Vt changes depending on the potential Vd of the secondary transfer counter roller 13 and the current changes.

As described above, since the tip end voltage is applied in order to stabilize the secondary transferability of the tip end of the recording material, it is not preferable that the tip end current changes depending on the potential of the secondary transfer counter roller 13. From Expression 8, the influence of the potential Vd of the secondary transfer counter roller 13 varies depending on α, and when α is greater than 1, ΔIt is positive, so that the images may be adversely affected by excessive secondary transfer current. Meanwhile, when α is less than 1, ΔIt is negative, and therefore the images may be adversely affected by a shortage of the secondary transfer current.

Features of First Embodiment

According to the embodiment, the fixed voltage for the secondary transfer is changed in response to a change in a value set for the primary transfer voltage. When the secondary transfer counter roller 13 has a potential Vd, desired current when the tip end voltage is applied must be It' derived from Expression 7. According to the embodiment, It'=It−ΔIt is established from Expression 8, and therefore voltage Vt" is defined as tip end voltage corresponding to It−ΔIt.

$$\begin{aligned}Vt'' &= R(It-\Delta It) \\ &= \alpha(V0-Vd)+\beta+Vd \\ &= \alpha V0+\beta+(1-\alpha)Vd\end{aligned} \tag{9}$$

Since V0 is determined while the secondary transfer counter roller 13 has the potential Vd, in Expression 9, the deviation of the tip end voltage caused by Vd is corrected by the third term, so that the potential difference between Vt" and the potential Vd of the secondary transfer counter roller 13 is equal to Vt'.

Functions and Effects of First Embodiment

FIG. 10 show the tip end voltage calculated according to the embodiment.

Nos. 1 to 3 show comparative values when the tip end voltage is Vt, and since the potential of the secondary transfer counter roller 13 is Vd, the potential difference between the secondary transfer roller 20 and the secondary transfer counter roller 13 increases by the function of Vd. As a result, an image is adversely affected by excessive secondary transfer current. The toner images on the intermediate transfer belt 10 are inverted to have the positive polarity and not transferred onto the recording material P or a blank by excessive current is generated, or unevenness in the image caused by discharge current generated from the secondary transfer roller 20 to the recording material P.

Nos. 4 to 6 show values for the tip end voltage Vt" according to the embodiment, and the deviation caused by the potential Vd of the secondary transfer counter roller 13 is corrected according to Expression 9, and the potential difference between Vt" and the potential of the secondary transfer counter roller 13 provides good secondary transfer performance. In other words, according to the embodiment, as the absolute water amount is smaller, the potential difference between the secondary transfer roller 20 and the secondary transfer counter roller 13 is corrected to be smaller than the value before the correction.

In the image forming apparatus according to the embodiment that forms a primary transfer potential by current supplied from the secondary transfer roller 20, the tip end voltage of the recording material P is corrected according to the potential Vd of the secondary transfer counter roller 13. In this way, an image forming apparatus that allows toner images at the tip end of the recording material P to be good with no secondary transfer failures can be provided.

In the description of the embodiment, the tip end voltage has been described, while when fixed voltage is also applied in the vicinity of the rear end of the recording material P as in the interval Din FIGS. 8A and 8B, higher secondary transfer performance can be provided by applying the rear end voltage according to Expression 9 similarly to the embodiment.

In the image forming apparatus according to the embodiment in which the potential of the secondary transfer counter roller 13 changes, the voltage of the secondary transfer counter roller 13 is maintained by connecting a Zener diode between the secondary transfer counter roller 13 and ground as shown in FIG. 1. However, the advantageous effects can be provided by other configurations.

Figures 11, 12:
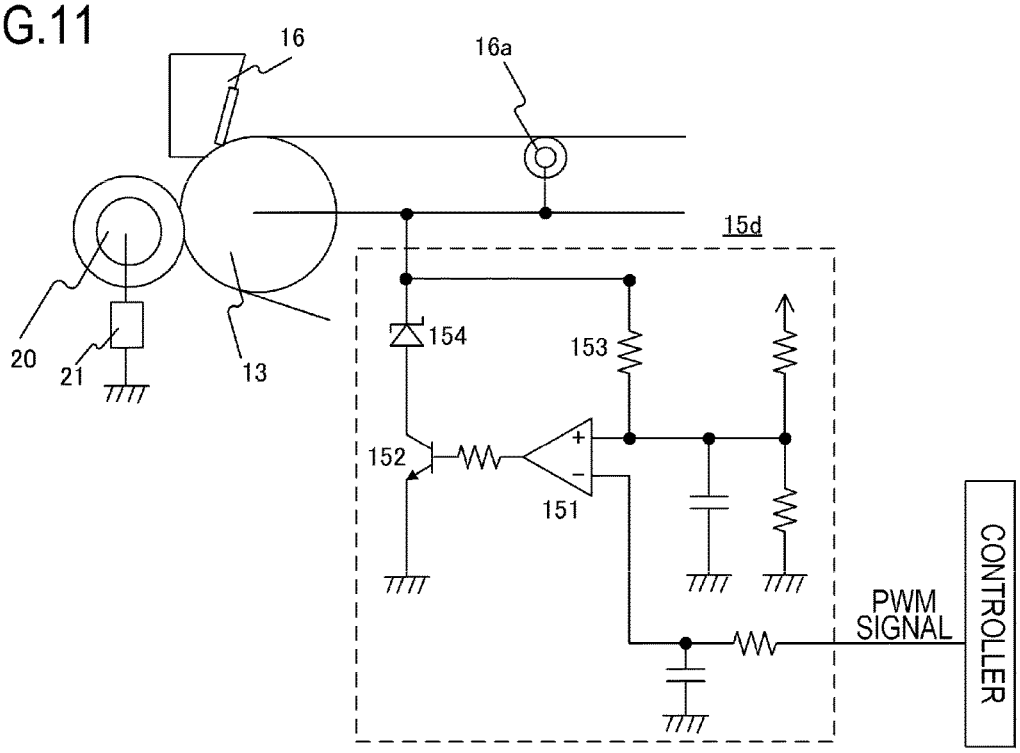
FIG. 11 is a view showing another image forming apparatus that provides advantageous effects brought about by the first embodiment.
FIG. 12 is a table showing fixed values used in determining minimum voltage according to the first embodiment.

For example, as shown in FIG. 11, the effects are similarly provided by an image forming apparatus having a voltage adjusting circuit 15*d* including a transistor 152 between the secondary transfer counter roller 13 and ground. In the image forming apparatus shown in FIG. 11, the primary transfer voltage causes current to be passed through the secondary transfer roller 20, the intermediate transfer belt 10, and the secondary transfer counter roller 13 as the secondary transfer voltage is output by the secondary transfer power supply 21. At the time, a PWM signal output from the controller is smoothened by a resistor and a capacitor and input to the inversion input terminal (minus terminal) of an operational amplifier 151, and the output voltage of the operational amplifier 151 is divided by a resistor and input to the base terminal of a transistor 152. In this way, the collector current is controlled, the collector-emitter voltage of the transistor is generated, and the generated voltage serves as the primary transfer voltage. More specifically, the voltage adjusting circuit 15*d* is configured to be capable of changing the amount of the current to be passed from the secondary transfer roller 20 as the current supply member to the intermediate transfer belt 10 depending on the level of the PWM signal input from the controller, in other words depending on the on-duty ratio. The controller controls the on-duty ratio of the PWM signal as a control signal, so that the amount of the current to be passed to the intermediate transfer belt 10 from the secondary transfer roller 20 is controlled, and the primary transfer voltage formed by the current may be controlled.

In this way, the image forming apparatus in FIG. 11 can set arbitrary voltage within the voltage range that can be set for the transistor. The voltage range that can be set for the transistor is for example from 0 V to 600 V, in other words, arbitrary voltage can be adjusted in the range from 0 V to 600 V. Therefore, good secondary transfer performance can be secured when optimum tip end voltage is applied for the primary transfer voltage set according to Expression 9.

Second Embodiment

An image forming apparatus according to a second embodiment of the present invention will be described. A feature of the second embodiment is control carried out when secondary transfer is carried out with fixed voltage in a high temperature and high humidity environment. In the configuration of the image forming apparatus according to the embodiment, the same elements as those of the first embodiment are designated by the same reference characters and their description will not be repeated.

In a high temperature and high humidity environment for example at a temperature of 30° C. and with a humidity of 80%, the amount of the absolute moisture in the environment is large, and the moisture in the environment is ionized, so that the secondary transfer roller 20 and the intermediate transfer belt 10 have lowered resistance values. The recording material absorbs the moisture and has a lowered resistance value. When the secondary transfer is carried out by the constant current control in the situation, the secondary transfer current is directly passed to the intermediate transfer belt 10 through the recording material, and therefore most part of the current is not passed through the toner images, so that a current shortage causes a secondary transfer failure. Therefore, in such a high temperature and high humidity environment, a greater amount of current than usual is necessary for the secondary transfer as the amount of moisture included in the recording material increases. Since optimum current setting is difficult, the constant voltage control is carried out in the high temperature and high humidity environment. The control is carried out for the purpose of determining minimum voltage for securing minimum secondary transfer current, and therefore hereinafter the control will be referred to as the "minimum voltage control."

Conditions for Carrying Out Minimum Voltage Control

The minimum voltage control is carried out in a high temperature and high humidity environment, and whether to carry out the control is determined on the basis of the absolute water amount according to the embodiment. The minimum voltage control is carried out for example when the absolute water amount is 14.6 g/m$^2$ or more according to the embodiment. The voltage Vlow determined by the minimum voltage control is produced by Expression 10 where γ represents a fixed coefficient.

$$Vlow = Vt'' - \gamma \qquad (10)$$
$$= \alpha V0 + \beta + (1 - \alpha)Vd - \gamma$$

Figures 13A, 13B:
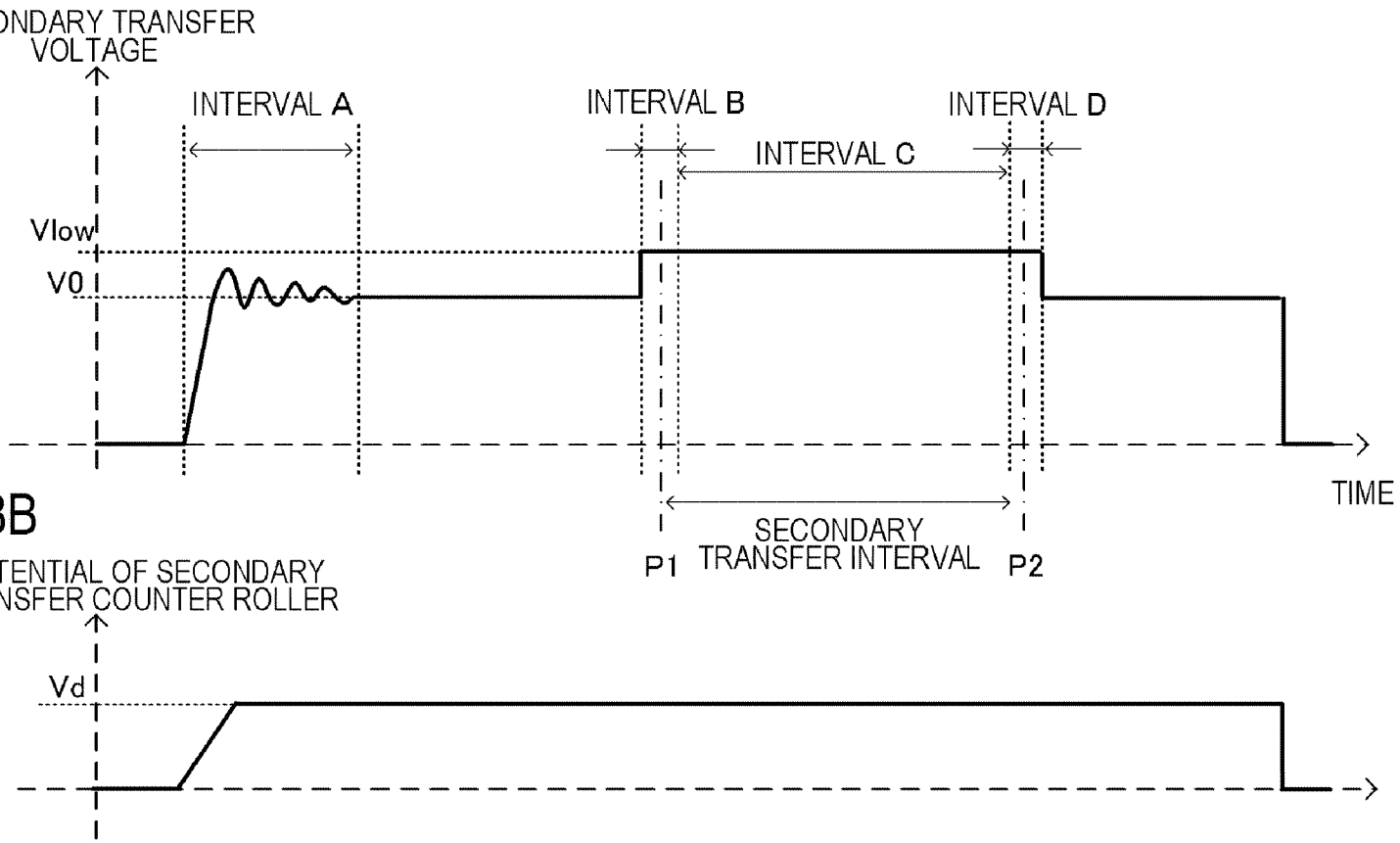
FIGS. 13A and 13B are timing charts for secondary transfer voltage according to a second embodiment of the invention.

The fixed coefficient γ is a value determined by the absolute water amount and previously given in a table as in FIG. 12. As can be understood from Expression 10, Vlow is the difference between Vt" and γ defined according to the first embodiment. As described in connection with the first embodiment, Vt" is voltage obtained by correcting the deviation caused by the potential Vd of the secondary transfer counter roller 13, and therefore Vlow is unaffected by the potential Vd of the secondary transfer counter roller 13 and is optimum voltage for the secondary transfer. As for the minimum voltage control, as shown in the timing chart in FIGS. 13A and 13B, Vlow determined according to Expression 3 is applied during the period before the recording material reaches the secondary transfer roller 20 until the material passes the secondary transfer roller 20.

Functions and Effects of Second Embodiment

FIG. 14 shows minimum voltage values calculated according to the embodiment.

Nos. 1 to 3 show comparative examples of minimum voltage obtained depending on Vt according to the first embodiment, the potential of the secondary transfer counter roller 13 is Vd, and therefore the potential difference between the secondary transfer roller 20 and the secondary transfer counter roller 13 is greater than the embodiment by the function of Vd. As a result, current obtained when the tip end voltage is applied is greater than the embodiment, and a blank by excessive current is generated by excessive secondary transfer current.

Nos. 4 to 6 show values obtained by Expression 10 according to the embodiment, the deviation caused by the potential Vd of the secondary transfer counter roller is corrected as can be understood from Expression 10, and therefore the potential difference between Vlow and the potential of the secondary transfer counter roller 13 provides improved secondary transfer performance.

As in the foregoing, according to the second embodiment, when the minimum voltage control is carried out, the minimum voltage obtained by correcting the fluctuation caused by the potential Vd of the secondary transfer counter roller 13 is set, so that an optimum contrast for the secondary transfer may be provided and good secondary transfer performance may be obtained.

Third Embodiment

An image forming apparatus according to a third embodiment of the present invention will be described. According to the third embodiment, fixed voltage is applied to charge elimination means for the recording material. In the configuration of the image forming apparatus according to the embodiment, the same elements as those of the first embodiment are designated by the same reference characters, and their description will not be repeated.

In the secondary transfer process, the secondary transfer roller 20 that transports the recording material while being contact with the back surface of the recording material is provided with voltage of the positive polarity, so that the toner images on the intermediate transfer belt 10 are transferred onto the recording material. At the time, since the charge of the positive polarity is applied to the recording material by the secondary transfer roller 20, the recording material may stick to the intermediate transfer belt 10 having the negative potential relative to the recording material or a separation failure may be caused. According to the embodiment, in order to prevent the separation failure, a charge elimination member for removing electricity from the charged recording material is provided.

Figure 15:
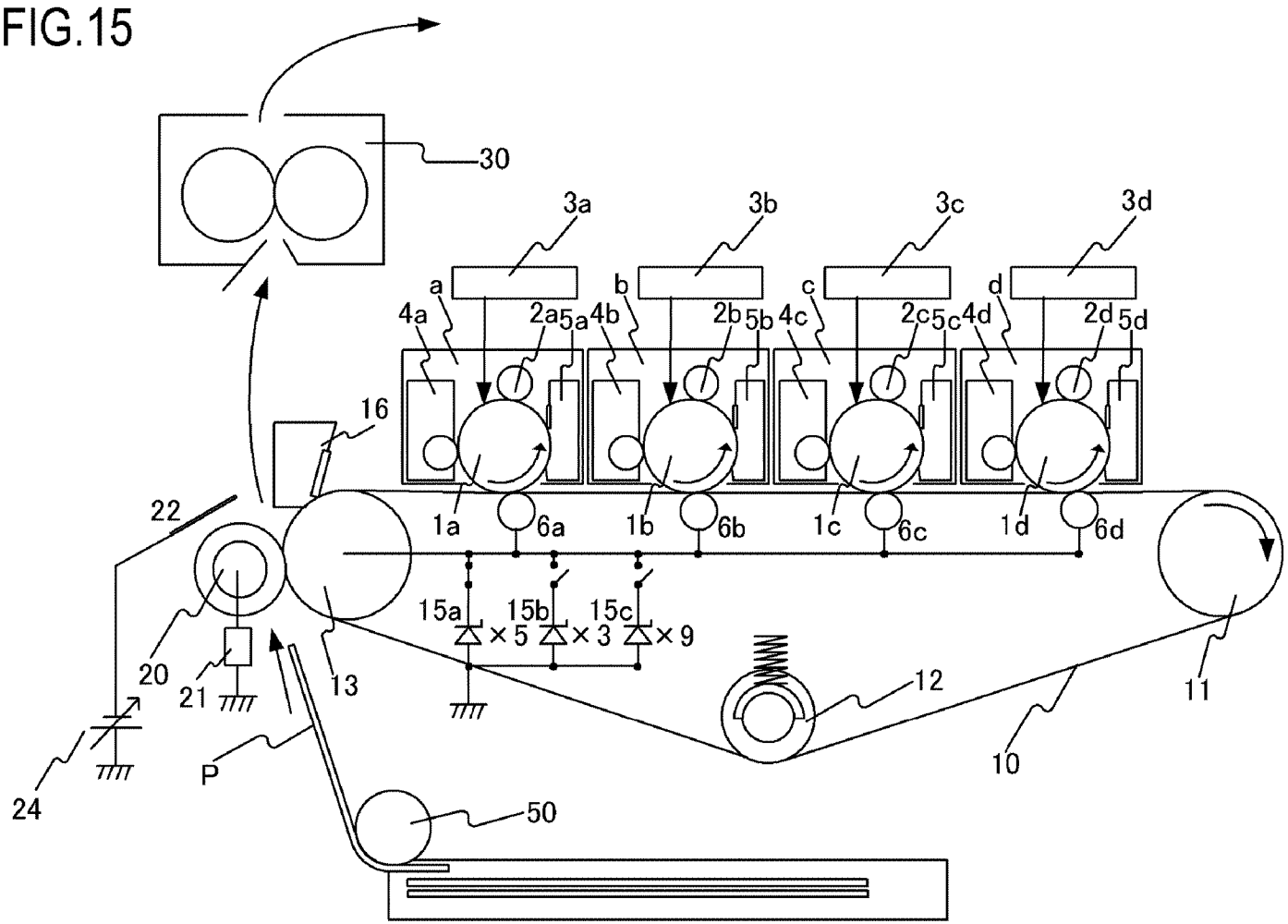
FIG. 15 is a view for illustrating an image forming apparatus according to a third embodiment of the invention.

FIG. 15 is a schematic view of the image forming apparatus according to the embodiment. A charge elimination needle 22 is provided in a position downstream of the secondary transfer roller 20 with respect to the transport direction of the recording material, and the charge elimination needle 22 is connected with a charge elimination needle power supply 24 adapted to apply voltage of the negative polarity to the charge elimination member 22.

Figure 16:
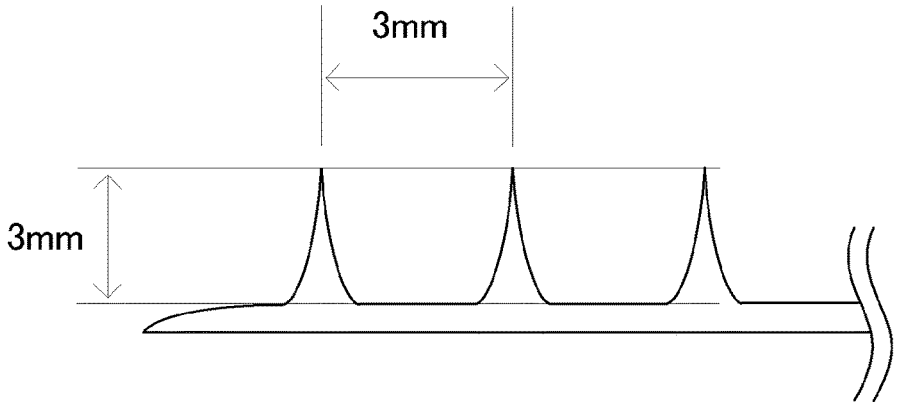
FIG. 16 is a schematic interval view of a charge elimination needle 22.

FIG. 16 is a schematic sectional view of the charge elimination needle 22 taken in the lengthwise direction. As shown in FIG. 16, the charge elimination needle 22 is in the shape of a needle having a height of 3 mm and a pitch of 3 mm and made of SUS 304 stainless steel.

According to the embodiment, voltage application to the charge elimination needle 22 is determined depending on the kind of the recording material. According to the embodiment, the charge elimination needle 22 is provided with voltage in order to prevent the separation failure for the recording material having a basis weight of 60 g or less. The tip end of the recording material needs only be separated from the intermediate transfer belt 10 in order to prevent the separation failure, and therefore the voltage is applied to the charge elimination needle 22 corresponding to the tip end voltage. The discharge current of the negative polarity generated from the charge elimination needle 22 removes the charge of the recording material P. The discharge current from the charge elimination needle 22 is determined on the basis of voltage applied to the charge elimination needle 22, the charge amount of the recording material, and the potential of the secondary transfer roller 20. The charge amount of the recording material is determined on the basis of the amount of charge supplied from the secondary transfer roller 20, and therefore the charge amount of the recording material changes according to the potential applied to the secondary transfer roller 20. According to the embodiment, voltage of the negative polarity is applied to the charge elimination needle 22 so that the potential difference between the charge elimination needle 22 and the secondary transfer roller 20 is equal to 1000 V.

The application voltage Vdis to the charge elimination needle 22 is applied according to Expression 11:

$$Vdis=-1000\ \mathrm{V}+Vt'' \tag{11}$$

where Vt" is the tip end voltage described in connection with the first embodiment and obtained by correcting the fluctuation amount caused by the potential Vd of the secondary transfer counter roller 13. Therefore, Vdis is always appropriate voltage depending on its relation with the secondary transfer roller 20 independently of the potential fluctuations of the secondary transfer counter roller 13.

As described above, in the configuration for removing the charge of the recording material by voltage applied to the charge elimination needle 22, the application voltage to the charge elimination needle 22 is determined according to Expression 11 in order to prevent the separation failure. In this way, the influence of the potential Vd of the secondary transfer counter roller 13 can be cancelled, so that a good separation characteristic can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-153993, filed on Aug. 4, 2016, which is hereby incorporated by reference herein in its entirety.

What is claimed is:

1. An image forming apparatus, comprising:

an image bearing member that bears a developer image;

an endless belt that rotates while being in contact with the image bearing member, the developer image borne by the image bearing member being subjected to primary transfer, the belt subjecting the primary-transferred developer image to secondary transfer onto a recording material;

a support member that supports an inner peripheral surface of the belt;

a current supply member that is in contact with the belt at a position opposed to the support member through the belt and that is provided with a voltage to pass current through a contact portion contacting with the belt, the current supply member being provided with a secondary transfer voltage, so that a potential difference for the secondary transfer is formed between the support member and the current supply member while the recording material is nipped by the contact portion;

a voltage applying portion that applies the voltage to the current supply member; and a potential adjusting portion that is capable of variably maintaining a potential of the support member at a prescribed sustaining potential and capable of changing the sustaining potential to change a potential of the belt, the voltage applying portion carrying out constant current control for applying the voltage to the current supply member so that an amount of current passed from the current supply member to the support member is equal to a prescribed amount, and applying a prescribed level of fixed voltage before the constant current control is started, the fixed voltage being a voltage corrected according to the sustaining potential maintained by the potential adjusting portion.

2. The image forming apparatus according to claim 1, wherein the constant current control is carried out according to a voltage-current characteristic of the current supply member.

3. The image forming apparatus according to claim 1, wherein the fixed voltage starts to be applied before a tip end of the recording material reaches the contact portion between the current supply member and the belt and continues to be applied until a prescribed time point since the tip end has reached the contact portion.

4. The image forming apparatus according to claim 1, wherein the voltage applying portion applies the fixed voltage also immediately after the constant current control ends.

5. The image forming apparatus according to claim 4, wherein the fixed voltage starts to be applied before a rear end of the recording material passes the contact portion between the current supply member and the belt and continues to be applied until a prescribed time point after the rear end passes the contact portion.

6. The image forming apparatus according to claim 1, further comprising a detection portion for detecting a temperature and a humidity, wherein the potential adjusting portion reduces the sustaining potential so that the potential of the belt decreases as an absolute water amount obtained from the temperature and the humidity detected by the detection portion increases.

7. The image forming apparatus according to claim 6, wherein the level of the fixed voltage is corrected so that the potential difference between the current supply member and the support member is smaller than that before the correction as the absolute water amount obtained from the temperature and the humidity detected by the detection portion decreases.

8. The image forming apparatus according to claim 1, wherein the potential adjusting portion has a plurality of voltage maintaining elements connected between the support member and ground and can change the number of voltage maintaining elements to be conducted among the plurality of voltage maintaining elements.

9. The image forming apparatus according to claim 8, wherein the voltage maintaining element is a Zener diode.

10. The image forming apparatus of claim 8, further comprising a potential maintaining member provided to be in contact with the belt in a position opposed to the image bearing member through the belt and connected to the voltage maintaining element so as to have a potential equal to that of the support member.

11. The image forming apparatus according to claim 1, further comprising a control portion that outputs a control signal having a variable level to the potential adjusting portion, wherein the potential adjusting portion has a transistor connected between the support member and ground and can change the potential of the support member according to the level of the control signal input from the control portion.

* * * * *